US011424066B2

(12) United States Patent
Ogawa et al.

(10) Patent No.: US 11,424,066 B2
(45) Date of Patent: Aug. 23, 2022

(54) ELECTRONIC COMPONENT INCLUDING PLANAR TRANSFORMER

(71) Applicant: TAMURA CORPORATION, Tokyo (JP)

(72) Inventors: Hiroo Ogawa, Saitama (JP); Tomohiko Yoshino, Saitama (JP)

(73) Assignee: TAMURA CORPORATION, Tokyo (JP)

( * ) Notice: Subject to any disclaimer, the term of this patent is extended or adjusted under 35 U.S.C. 154(b) by 542 days.

(21) Appl. No.: 16/413,885

(22) Filed: May 16, 2019

(65) Prior Publication Data

US 2019/0371514 A1 Dec. 5, 2019

(30) Foreign Application Priority Data

Jun. 1, 2018 (JP) ..... JP2018-106182

(51) Int. Cl.
*H01F 27/28* (2006.01)
*H01F 27/24* (2006.01)

(52) U.S. Cl.
CPC ..... *H01F 27/2804* (2013.01); *H01F 27/24* (2013.01); *H01F 2027/2814* (2013.01); *H01F 2027/2819* (2013.01)

(58) Field of Classification Search
CPC ..... H01F 27/2804; H01F 27/24; H01F 2027/2814; H01F 2027/2819;
(Continued)

(56) References Cited

U.S. PATENT DOCUMENTS 4,873,757 A * 10/1989 Williams ..... H01F 17/0013 29/602.1
5,990,776 A * 11/1999 Jitaru ..... H01F 27/2804 336/200

(Continued)

FOREIGN PATENT DOCUMENTS

JP H08236365 A 9/1996
JP 2004112991 A 4/2004

(Continued)

OTHER PUBLICATIONS

Japanese Office Action dated Nov. 26, 2019 (and English translation thereof) issued in Japanese Application No. 2018-106182.

(Continued)

*Primary Examiner* — Mang Tin Bik Lian
(74) *Attorney, Agent, or Firm* — Holtz, Holtz & Volek PC

(57) ABSTRACT

An electronic component 100 includes: a circuit board module 104 which is composed of a plurality of layers, and in which a primary circuit 120 and secondary circuits 122, 124 are each formed using wring patterns of a first layer L1 to an eighth layer L8; and a magnetic core 106 which magnetically couples the primary circuit 120 and the secondary circuits 122, 124. The circuit board module 104 includes: a primary winding 120*b* and secondary windings 122*b*, 124*b* which are formed spirally around the magnetic core 106; and a third layer L3 and a sixth layer L6 interposed between a fourth layer L4 of the primary winding 120*b* and a second layer L2 of the secondary winding 122*b* and between a fifth layer L5 of the primary winding 120*b* and a seventh layer L7 of the secondary winding 124*b*.

10 Claims, 7 Drawing Sheets

(58) Field of Classification Search
CPC ..... H01F 2027/2809; H01F 27/306; H01F 27/323; H01F 17/0006; H01F 17/0013; H01F 2017/002; H01F 2017/0073; H02M 3/24
See application file for complete search history.

(56) References Cited

U.S. PATENT DOCUMENTS 6,198,374 B1 3/2001 Abel
6,972,656 B2 * 12/2005 Takeshima ..... H02M 3/3376 336/180
8,054,154 B2 * 11/2011 Koprivnak ..... H01F 27/2804 333/170
8,334,747 B2 12/2012 Matsumoto
9,460,844 B2 * 10/2016 Scholz ..... H01F 27/2804
2002/0070834 A1 * 6/2002 Dadafshar ..... H01F 17/0013 336/200
2004/0032313 A1 * 2/2004 Ferencz ..... H05K 1/165 336/200
2005/0052888 A1 3/2005 Takeshima et al.
2005/0242916 A1 * 11/2005 So ..... H01F 27/2804 336/200
2008/0278275 A1 11/2008 Fouquet et al.
2010/0079229 A1 * 4/2010 Koprivnak ..... H01F 27/29 336/200
2010/0117777 A1 * 5/2010 Tan ..... H01F 27/292 336/65
2010/0219926 A1 * 9/2010 Willers ..... H01F 27/2804 336/200
2012/0049991 A1 * 3/2012 Baarman ..... H02J 7/0044 336/199
2012/0112866 A1 * 5/2012 Matsumoto ..... H01F 27/22 336/61
2012/0160553 A1 * 6/2012 Shimadu ..... H05K 3/202 174/261
2013/0335927 A1 * 12/2013 Boone ..... A61N 1/3981 361/748
2016/0035480 A1 * 2/2016 Hachiya ..... H01F 27/22 336/200
2018/0174730 A1 6/2018 Scholz

FOREIGN PATENT DOCUMENTS

JP 2005102485 A 4/2005
JP 2008166625 A 7/2008
JP 5310857 B2 10/2013
JP 2021005725 A 1/2021
WO 2016193017 A1 12/2016

OTHER PUBLICATIONS

Extended European Search Report (EESR) dated Oct. 1, 2019 issued in European Application No. 19175364.9.
Japanese Office Action (and English language translation thereof) dated Apr. 6, 2021 issued in Japanese Application No. 2018-106182.
Japanese Office Action (and English language translation thereof) dated Feb. 22, 2022, issued in Japanese Application No. 2020-158237.

* cited by examiner

ELECTRONIC COMPONENT INCLUDING PLANAR TRANSFORMER

BACKGROUND OF THE INVENTION

Field of the Invention

The present invention relates to an electronic component, specifically relates to an electronic component having a planar transformer.

Description of the Related Art

A printed coil transformer is one form of a planar transformer. The printed coil transformer has a combined structure of a stack of boards and a magnetic core, and the stack is composed of many stacked double-sided boards. On each of the double-sided boards, patterns of primary coils or patterns of secondary coils are formed. The double-sided boards which are adjacent in the stack are insulated from each other by a prepreg filled therebetween.

SUMMARY OF THE INVENTION

The present invention disclosed and claimed herein, in one aspect thereof, comprises an electronic component. The component includes: a circuit board with a multilayer structure in which a primary circuit and a secondary circuit are each formed using a plurality of layers of wiring patterns; a magnetic core attached to the circuit board to magnetically couple the primary circuit and the secondary circuit; a primary winding which is constituted by the wiring pattern formed spirally around the magnetic core in a layer inside the circuit board and constitutes part of the primary circuit; a secondary winding which is constituted by the wiring pattern formed spirally around the magnetic core in a layer inside the circuit board and constitutes part of the secondary circuit; and an insulating layer interposed between the layer of the primary winding and the layer of the secondary winding inside the circuit board and not having the wiring patterns in regions that overlap with the windings in a layer direction.

Further scope of applicability of the present invention will become apparent from the detailed description given hereinafter. The detailed description and embodiments are only given as examples though showing preferred embodiments of the present invention, and therefore, from the contents of the following detailed description, changes and modifications of various kinds within the spirits and scope of the invention will become apparent to those skilled in the art.

BRIEF DESCRIPTION OF THE DRAWINGS

The present invention will be fully understood from the following detailed description and the accompanying drawings. The accompanying drawings only show examples and are not intended to restrict the present invention. In the accompanying drawings.

DETAILED DESCRIPTION

Figure 1:
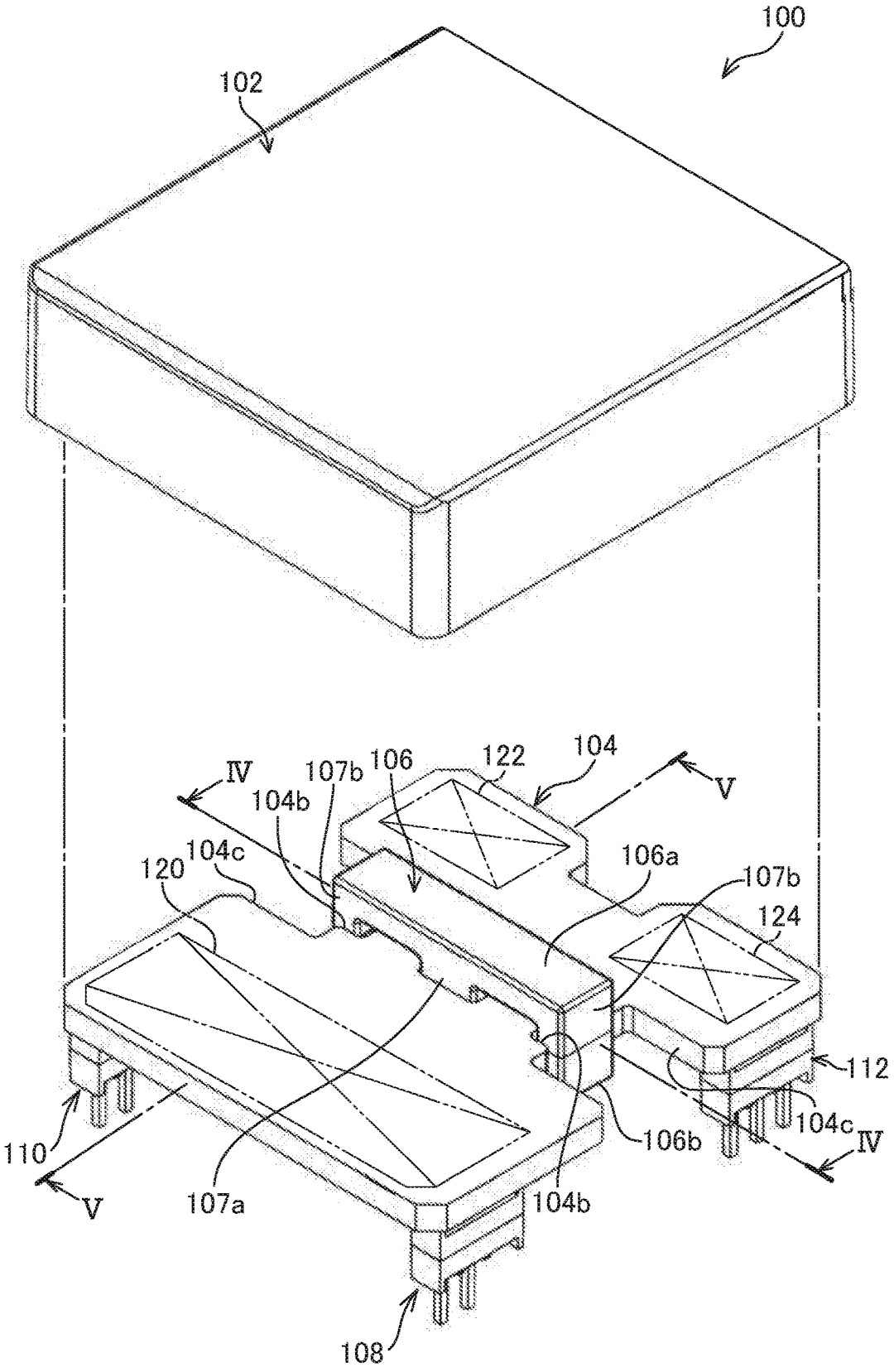
FIG. 1 is an exploded perspective view schematically illustrating the structure of an electronic component of one embodiment.

FIG. 1 schematically illustrates the structure of an electronic component 100 of one embodiment. In this embodiment, a module-type DC-DC converter is taken as an example of the electronic component 100, but an example of the electronic component 100 is not limited to this. Hereinafter, the structure of the electronic component 100 will be described.

The electronic component 100 is composed roughly of a resin case 102 and a circuit board module 104, for instance. The inside of the resin case 102 is sealed with a filler (for example, urethane resin) in a state where the circuit board module 104 is housed in the resin case 102, and as a result, the electronic component 100 is completed. The resin case 102 has a hollow cover shape, and its lower surface has the same shape as the outer shape of the circuit board module 104 and is open.

A magnetic core 106 is combined with the circuit board module 104. In the circuit board module 104, a primary circuit 120 and two systems of secondary circuits 122, 124 of the DC-DC converter are mainly formed, and when the DC-DC converter operates, the primary circuit 120 is magnetically coupled with the secondary circuits 122, 124 by the magnetic core 106. Note that the primary circuit 120 and the secondary circuits 122, 124 have various electronic components mounted on their upper surfaces in terms of the direction in FIG. 1 of the circuit board module 104, but the illustration of these electronic components is omitted.

Figure 2:
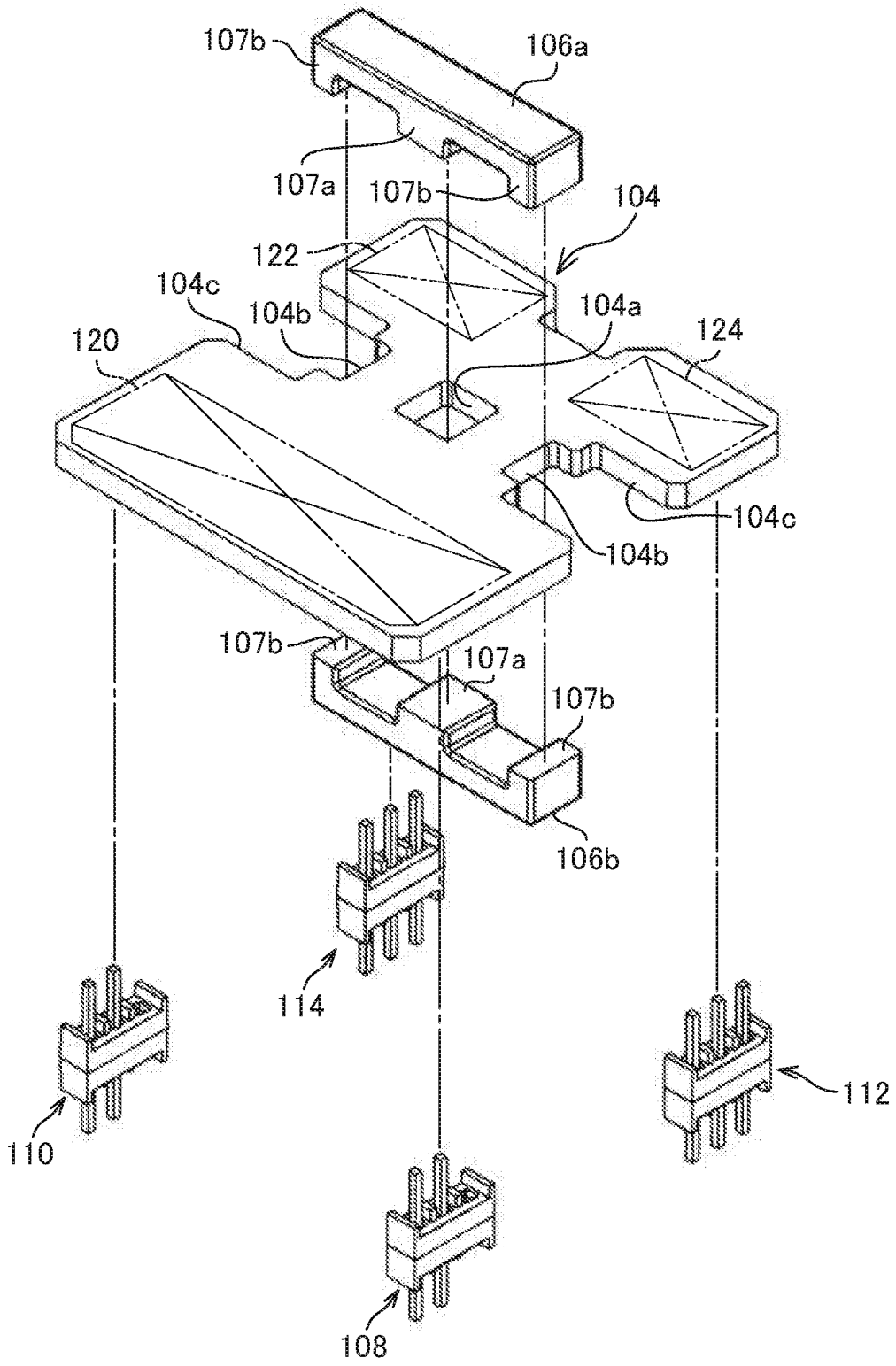
FIG. 2 is an exploded perspective view illustrating only a circuit board module.

FIG. 2 illustrates only the circuit board module 104 in a disassembled state. In the circuit board module 104, not only the magnetic core 106 is combined as described above but also a plurality of input terminal arrays 108, 110 and output terminal arrays 112, 114 are mounted.

The magnetic core 106 has, for example, an E-E structure, in which two core parts 106*a*, 106*b* are combined from both surface sides of the circuit board module 104 so as to face each other. In this embodiment, there is no gap between the two core parts 106*a*, 106*b* of the magnetic core 106, but there may be a gap therebetween. For the assembly of the magnetic core 106, the circuit board module 104 has an insertion hole 104*a* formed at a position close to the center, and in addition, has a pair of cutout portions 104*b* formed in both side edge portions with the insertion hole 104*a* therebetween.

The insertion hole 104*a* is opened in a substantially square shape in both the surfaces of the circuit board module 104 and penetrates through the circuit board module 104 in the thickness direction, and in the insertion hole 104*a*, middle legs 107*a* of the magnetic core 106 are inserted from both sides.

The pair of cutout portions 104*b* are formed in a U-shape from both the side edge portions toward an inner side of the circuit board module 104, and both outer legs 107*b* of the magnetic core 106 are fitted to the pair of cutout portions 104*b*. Note that, in this embodiment, the pair of cutout portions 104*b* form holding spaces 104*c*. Specifically, side portions of the pair of cutout portions 104*b* widen in the width direction by one step, which makes the holding spaces 104*c* to function as follows. That is, the holding spaces 104*c* function as spaces for an assembly work of the magnetic core 106. The assembly work includes, for example, in the state where the magnetic core 106 is assembled to the circuit board module 104 as illustrated in FIG. 1, applying an adhesive on abutting surfaces in both sides of the two core parts 106*a*, 106*b*, sticking an adhesive tape, or clipping the core parts 106*a*, 106*b* together. The holding spaces 104*c* improve assembly workability of the electronic component 100 to enhance production efficiency, thereby capable of contributing to a manufacturing cost reduction.

The input terminal arrays 108, 110 are mounted on the circuit board module 104 through not illustrated through holes to be connected to the primary circuit 120. The output terminal arrays 112, 114 are also mounted on the circuit board module 104 through not illustrated through holes to be connected to the secondary circuits 122, 124. In the completed electronic component 100, these input terminal arrays 108, 110 and output terminal arrays 112, 114 project downward from the resin case 102.

Figure 3:
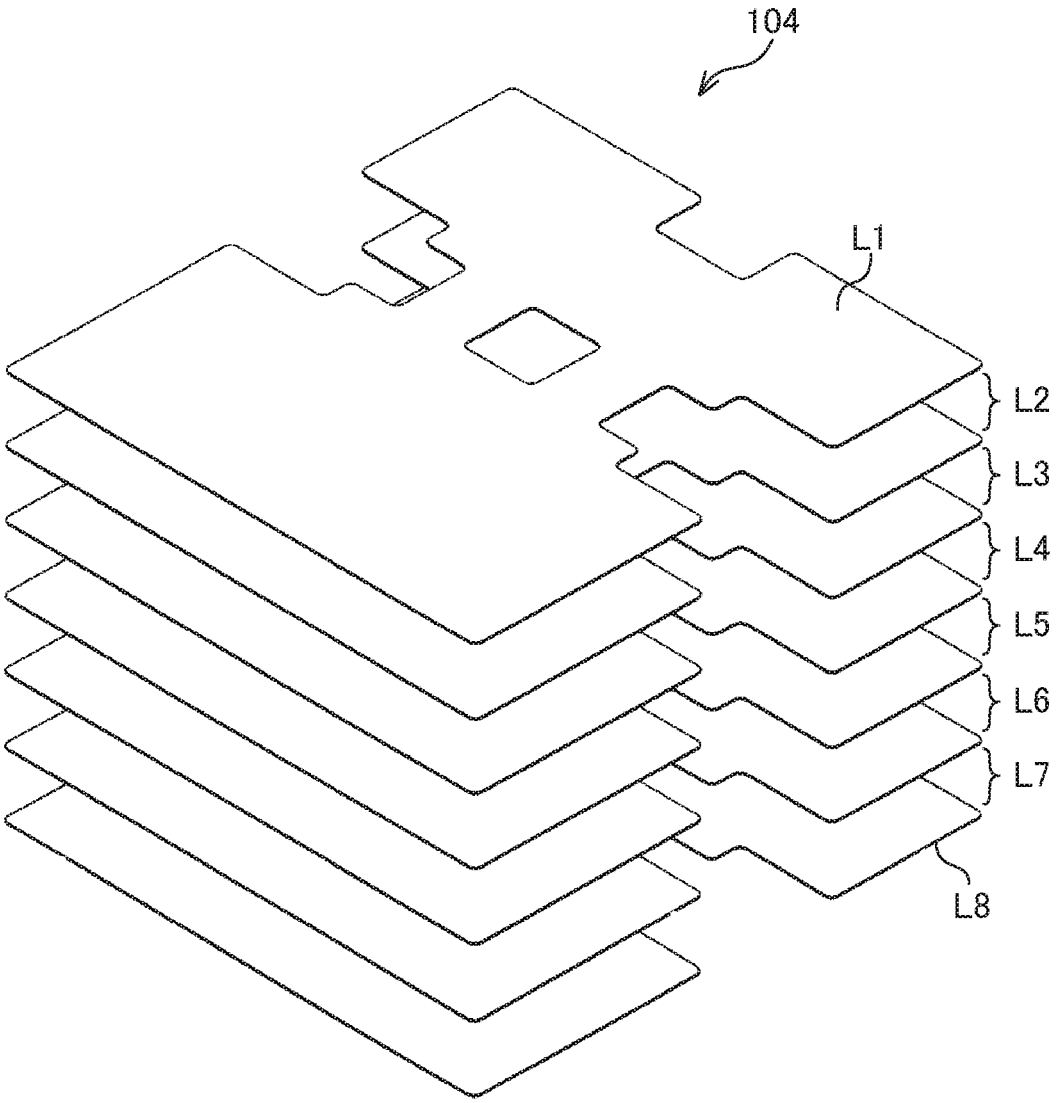
FIG. 3 is an exploded perspective view schematically illustrating a multilayer structure of the circuit board module.

FIG. 3 schematically illustrates a multilayer structure of the circuit board module 104 and illustrates its state of being disassembled into many boards for stacking. In the completed circuit board module 104, all the boards for stacking are integrated because they have undergone firing, and in this structure, the post-disassembly is not possible, but here the disassembled state is illustrated for convenience of the understanding of the multilayer structure.

The circuit board module 104 has the multilayer structure composed of a stack of, for example, seven sheets of the boards for stacking (called sheet boards, green sheets, or the like) which have been integrally fired. Hereinafter, for convenience' sake, an upper surface of the uppermost layer in the stacking direction will be referred to as a first layer L1, a space between its lower surface and an upper surface of a board for stacking at the second highest position as a second layer L2, a space between its lower surface and an upper surface of a board for stacking at the third highest position as a third layer L3, a space between its lower surface and an upper surface of a board for stacking at the fourth highest position as a fourth layer L4, a space between its lower surface and an upper surface of a board for stacking at the fifth highest position as a fifth layer L5, a space between its lower surface and an upper surface of a board for stacking at the sixth highest position as a sixth layer L6, a space between its lower surface and an upper surface of a board for stacking at the seventh highest position as a seventh layer L7, and a lower surface of the lowest board for stacking as an eighth layer L8.

First, the layer structure will be described with reference to sections of the circuit board module 104.

Figure 4:
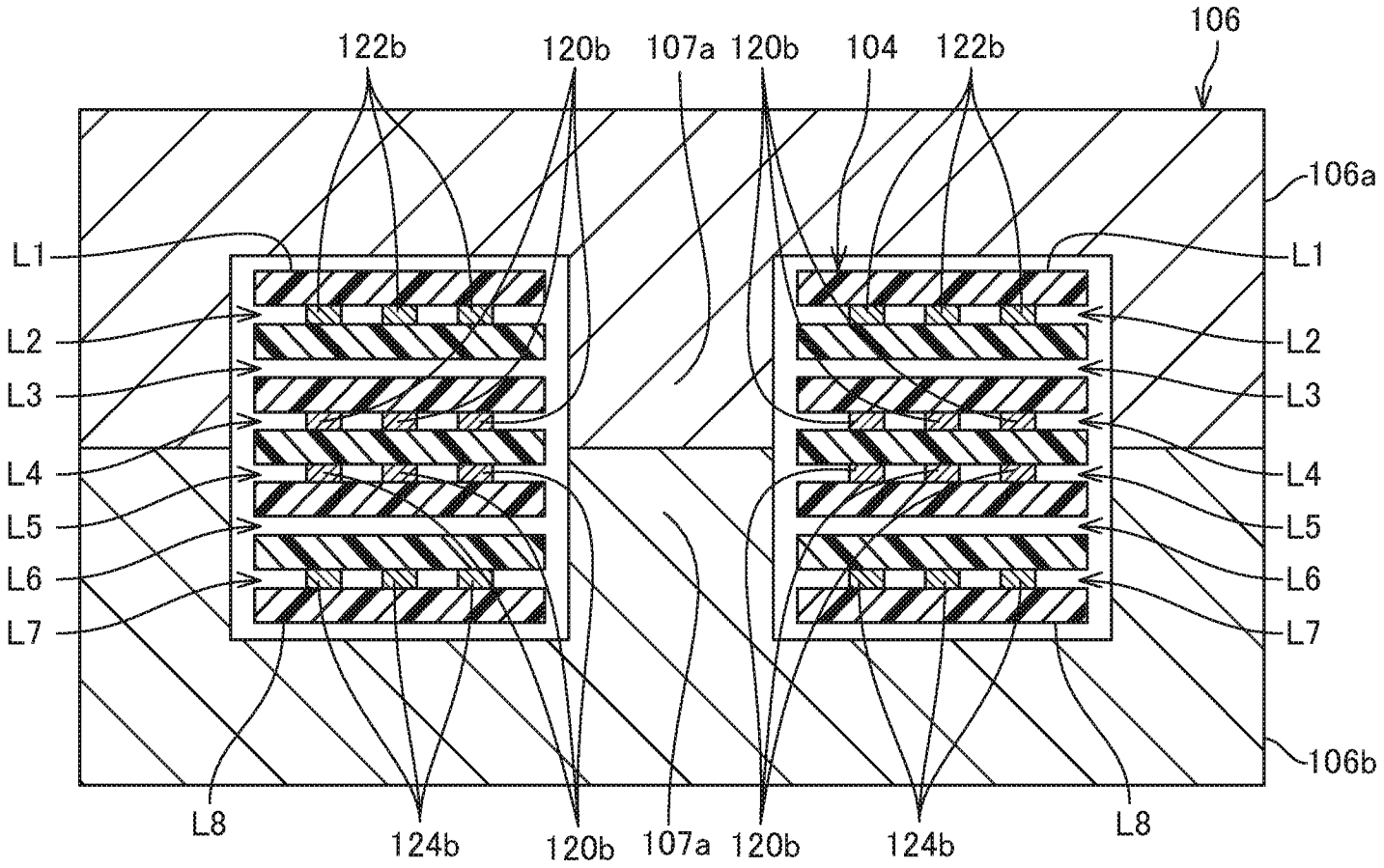
FIG. 4 is a vertical sectional view taken along the IV-IV line in FIG. 1.
Figure 5:
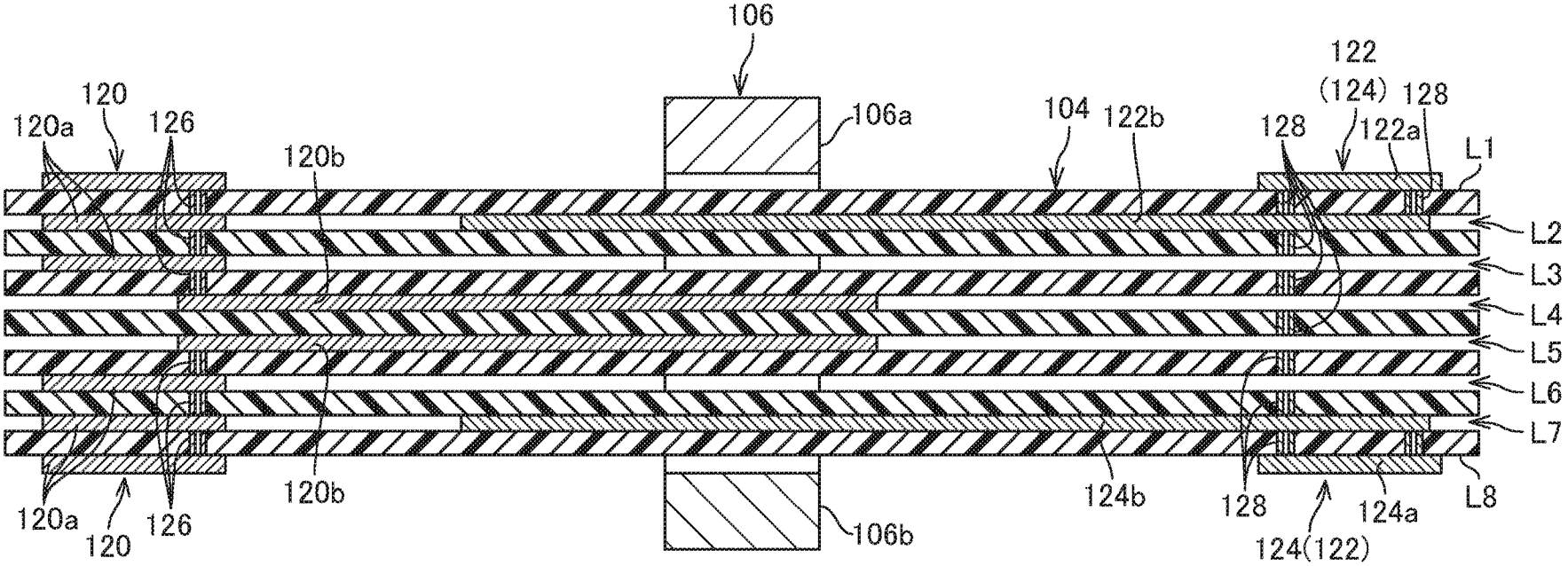
FIG. 5 is a vertical sectional view taken along the V-V line in FIG. 1.

FIG. 4 illustrates a vertical section of the circuit board module 104 and the magnetic core 106 along the longitudinal direction of the magnetic core 106 (IV-IV section in FIG. 1). Further, FIG. 5 illustrates a vertical section of the circuit board module 104 and the magnetic core 106 along the width direction of the magnetic core 106 (V-V section in FIG. 1). Note that, in FIG. 4 and FIG. 5, the layers of the boards for stacking and wiring patterns are each illustrated with an exaggerated thickness. Hereinafter, the arrangement of the wiring patterns in the layers will be described.

[First Layer (Uppermost Layer)]

The first layer L1 is located on the upper surface of the circuit board module 104. In the first layer L1, a primary pattern 120*a* constituting a wiring pattern of the primary circuit 120 is mainly formed, and a secondary pattern 122*a* constituting a wiring pattern of the secondary circuit 122 is also formed. These primary pattern 120*a* and secondary pattern 122*a* are each arranged at a position apart from regions immediately under and near the magnetic core 106 by a predetermined insulation distance.

[Second Layer (Second Highest Layer)]

The second layer L2 is located in a layer inside the circuit board module 104. In the second layer L2, a primary pattern 120*a* and in addition, a secondary winding 122*b* constituting a wiring pattern of the secondary circuit 122 is formed. The primary pattern 120*a* is arranged apart from the magnetic core 106, but the secondary winding 122*b* is arranged so as to depict a spiral shape around the magnetic core 106 (middle legs 107*a*).

[Third Layer (Third Highest Layer)]

The third layer L3 is located in a layer inside the circuit board module 104. In the third layer L3, only a primary pattern 120*a* is arranged.

[Fourth Layer (Fourth Highest Layer)]

The fourth layer L4 is located in a layer inside the circuit board module 104. In the fourth layer L4, only a primary winding 120*b* is formed.

The primary winding 120*b* is arranged so as to depict a spiral shape around the magnetic core 106 (middle legs 107*a*).

[Fifth Layer (Fifth Highest Layer)]

The fifth layer L5 is located in a layer inside the circuit board module 104. In the fifth layer L5, only a primary winding 120*b* is formed. As in the aforesaid fourth layer L4, the primary winding 120*b* is arranged so as to depict a spiral shape around the magnetic core 106.

[Sixth Layer (Sixth Highest Layer)]

The sixth layer L6 is located in a layer inside the circuit board module 104. In the sixth layer L6, only a primary pattern 120*a* is arranged.

[Seventh Layer (Seventh Highest Layer)]

The seventh layer L7 is located in a layer inside the circuit board module 104. In the seventh layer L7, a primary pattern 120*a* and in addition a secondary winding 124*b* constituting a wiring pattern of the secondary circuit 124 which is a different system from that in the first and second layers are formed. As in the aforesaid second layer, the primary pattern 120*a* is arranged apart from the magnetic core 106, but the secondary winding 124*b* is arranged so as to depict a spiral shape around the magnetic core 106 (middle legs 107*a*).

[Eighth Layer (Eighth Highest Layer)]

The eighth layer L8 is located on the lower surface of the circuit board module 104. In the eighth layer L8, a primary pattern 120*a* constituting a wiring pattern of the primary circuit 120 is mainly formed, and in addition a secondary pattern 124*a* constituting a wiring pattern of the secondary circuit 124 which is a different system from that in the first and second layers are formed. These primary pattern 120*a* and secondary pattern 124*a* are each arranged at a position apart from regions immediately under and near the magnetic core 106 by a predetermined insulation distance when seen from the lower direction of the magnetic core 106.

As illustrated in FIG. 5, in the circuit board module 104, primary via holes 126 and secondary via holes 128 are also formed. The primary via holes 126 each connect the wiring patterns in a plurality of layers of the primary circuit 120, for example, connect the primary pattern 120*a* and the primary winding 120*b*. The secondary via holes 128 each connect the wiring patterns of the plurality of layers of the secondary circuits 122, 124, for example, connect the secondary pattern 122*a* and the secondary winding 122*b*, and the secondary pattern 124*a* and the secondary winding 122*b*. Note that the illustrated width-direction positions of the primary via holes 126 and the secondary via holes 128 are only for convenience' sake.

Next, the planar structures of the layers will be described.

FIG. 6A to FIG. 6D are plan views of the layers from the first layer L1 to the fourth layer L4. FIG. 7A to FIG. 7D are plan views of the layers from the fifth layer L5 to the eighth layer L8. Note that, as the plan view of the eighth layer L8, a plane seen from the bottom (lower surface) of the circuit board module 104 is illustrated. In FIG. 6A to FIG. 6D and FIG. 7A to FIG. 7D, detailed illustrations of the shapes of the wiring patterns, the arrangements of other via holes and through holes, and so on are omitted.

[First Layer (Uppermost Layer)]

Figure 6A:
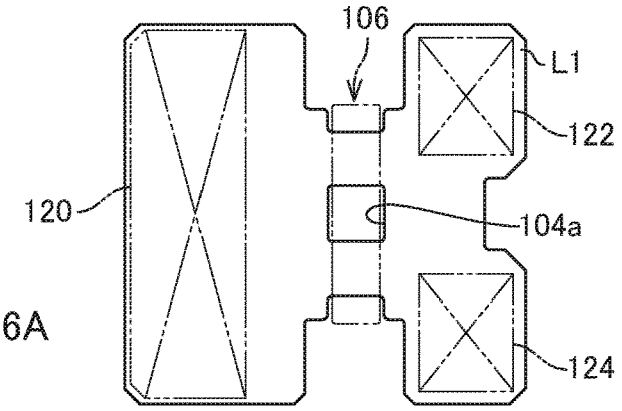
FIG. 6A to FIG. 6D are plan views of layers from a first layer to a fourth layer.

FIG. 6A: In the first layer L1, the primary circuit 120 and the two systems of secondary circuits 122, 124 (including the wiring patterns and mounted components) are formed as described above, but none of the primary winding 120*b* and the secondary windings 122*b*, 124*b* is arranged. Further, insulation distances of the primary circuit 120 and the secondary circuits 122, 124 from the magnetic core 106 are large enough to improve withstand (withstand voltage) performance. In this embodiment, none of the primary winding 120*b* and the secondary windings 122*b*, 124*b* is formed in the first layer L1 and thus they are not exposed to the periphery of the magnetic core 106, which also greatly contributes to an improvement in withstand performance.

[Second Layer (Second Highest Layer)]

Figure 6B:
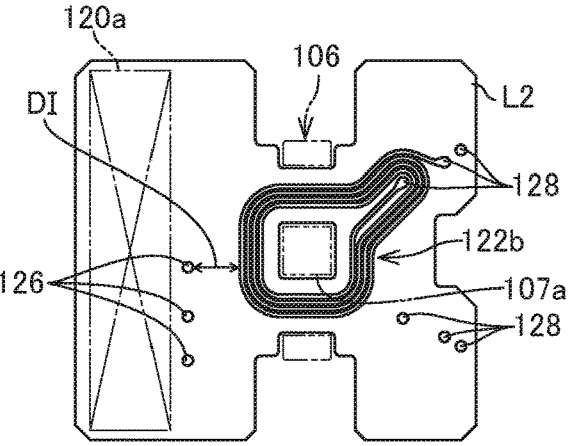

FIG. 6B: In the second layer L2, the wiring pattern of the secondary winding 122*b* is formed as described above. Here, when focusing on the pattern shape of the secondary winding 122*b*, it is seen that the positions of its outer peripheral end and inner peripheral end (not denoted by reference signs) are both apart from the middle legs 107*a* of the magnetic core 106 in an outward direction. Besides, in the second layer L2, the primary pattern 120*a* is formed.

[Third Layer (Third Highest Layer)]

Figure 6C:
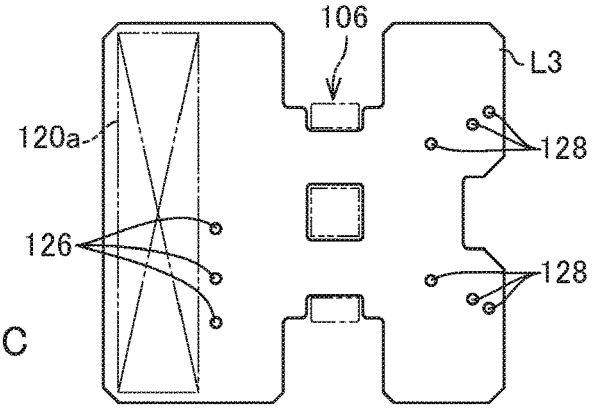

FIG. 6C: In the third layer L3, only the primary pattern 120*a* is mainly formed as described above. Thus, this embodiment does not have a structure in which the primary winding 120*b* is formed so as to be adjacent to the secondary winding 122*b* of the second layer L2.

[Fourth Layer (Fourth Highest Layer)]

Figure 6D:
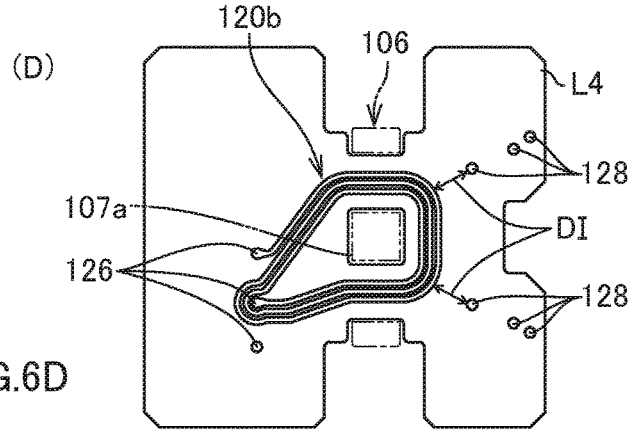

FIG. 6D: In the fourth layer L4, the wiring pattern of the primary winding 120*b* is formed apart from the second layer L2 with the third layer L3 therebetween. Here as well, when focusing on the pattern shape of the primary winding 120*b*, it is seen that the positions of its outer peripheral end and inner peripheral end (not denoted by reference signs) are both apart from the middle legs 107*a* of the magnetic core 106 in a direction which is the outward direction and the direction opposite to the direction in which those of the secondary winding 122*b* are apart.

As is apparent from the planar structures of the layers described so far, the insulation distance is provided in this embodiment as follows.

(1) FIG. 6C: The third layer L3 is interposed as an insulating layer between the second layer L2 and the fourth layer L4, and in the third layer L3, in its regions overlapping with the secondary winding 122*b* and the primary winding 120*b* in the layer direction, neither of these wiring patters is formed. Consequently, the insulation distance corresponding to two layers (larger than one layer) is provided between the primary winding 120*b* and the secondary winding 122*b*.

(2) FIG. 6B and FIG. 6D: The primary winding 120*b* and the secondary winding 122*b* are both arranged such that not only their outer peripheral ends but also their inner peripheral ends are apart in the outward direction from the middle legs 107*a* of the magnetic core 106. Specifically, the secondary winding 122*b* of the second layer L2 is arranged such that neither of its inner peripheral end and outer peripheral end overlaps with the primary winding 120*b* of the fourth layer L4 in the layer direction, and the primary winding 120*b* of the fourth layer L4 is arranged such that neither of its inner peripheral end and outer peripheral end overlaps with the secondary winding 122*b* of the second layer L2 in the layer direction. Accordingly, in the second layer L2, the positions of the primary via holes 126 are outside a winding region of the secondary winding 122*b*, and a predetermined insulation distance DI is provided therebetween. Further, in the fourth layer L4, the positions of the secondary via holes 128 are outside a winding region of the primary winding 120*b*, and a predetermined insulation distance DI is also provided therebetween. Note that the insulation distances DI in the second layer L2 and the fourth layer L4 may be different.

Typically, the wiring patterns of the primary winding 120*b* and the secondary winding 122*b* basically depict the spiral shape around the middle legs 107*a*, and the purpose of this arrangement is to converge a magnetic flux in the magnetic core 106. Accordingly, the inner peripheral ends are thought to be naturally arranged near the middle legs 107*a*. However, in this embodiment, the inner peripheral ends are also disposed intentionally at positions apart from the middle legs 107*a* in the outward direction. This ensures that the insulation distance DI between the primary winding 120*b* and the secondary via holes 128 of the other side is large, and the insulation distance DI between the secondary winding 122*b* and the primary via holes 126 of the other side is large as described above.

(3) FIG. 6A: In addition, the non-exposure of the secondary winding 122*b* to the outer surface of the circuit board module 104 also ensures that the insulation distance is provided from the magnetic core 106.

Next, the insulation from the secondary circuit 124 which is a different system will be described with reference to FIG. 7A to FIG. 7D.

[Fifth Layer (Fifth Highest Layer)]

Figure 7A:
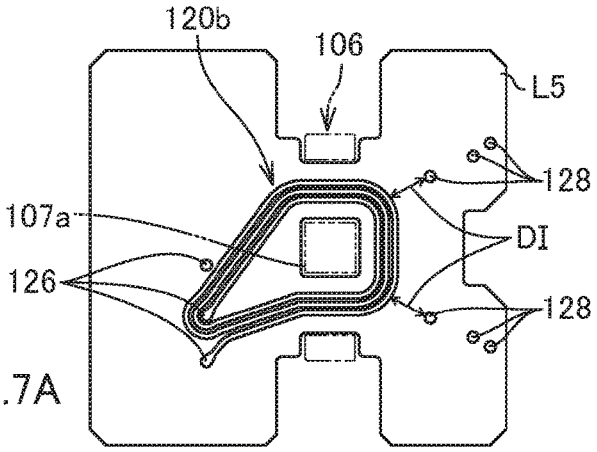
FIG. 7A to FIG. 7D are plan views of layers from a fifth layer to an eighth layer.

FIG. 7A: In the fifth layer L5, the wiring pattern of the primary winding 120*b* is formed. Here as well, when focusing on the pattern shape of the primary winding 120*b*, it is seen that the positions of its outer peripheral end and inner peripheral end (not denoted by reference signs) are both apart from the middle legs 107*a* of the magnetic core 106 in a direction which is the outward direction and the direction opposite to the direction in which those of the secondary windings 122*b*, 124*b* are apart.

[Sixth Layer (Sixth Highest Layer)]

Figure 7B:
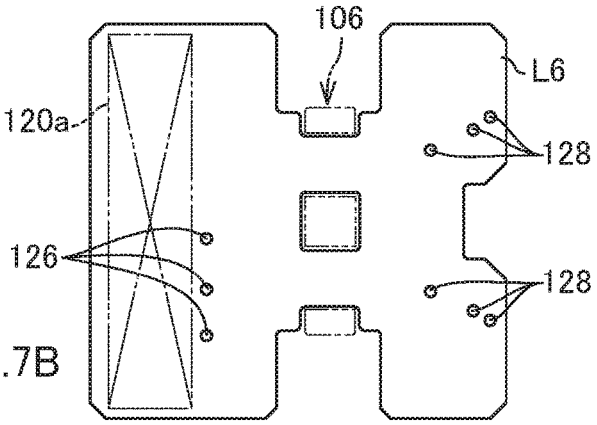

FIG. 7B: In the sixth layer L6, only the primary pattern 120*a* is mainly formed. Therefore, this embodiment does not have a structure in which the secondary winding 124*b* is formed so as to be adjacent to the primary winding 120*b* of the fifth layer L5.

[Seventh Layer (Seventh Highest Layer)]

Figure 7C:
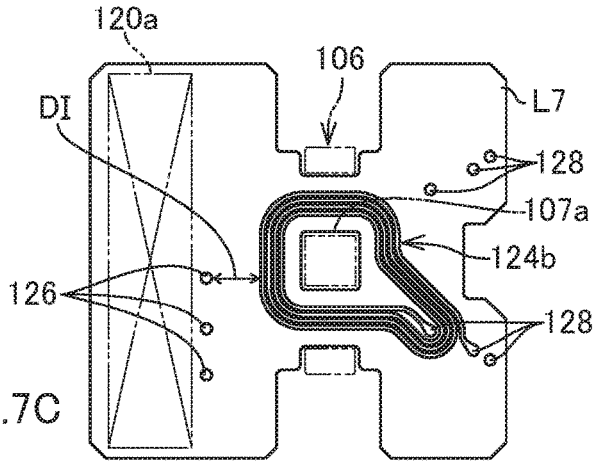

FIG. 7C: As described above, in the seventh layer L7, the wiring pattern of the secondary winding 124*b* is formed apart from the fifth layer L5 with the sixth layer L6 therebetween. Here as well, when focusing on the pattern shape of the secondary winding 124*b*, it is seen that the positions of its outer peripheral end and inner peripheral end (not denoted by reference signs) are both apart from the middle legs 107*a* of the magnetic core 106 in the outward direction. Note that, in the seventh layer L7, besides the secondary winding 124*b*, the primary pattern 120*a* is formed.

[Eighth Layer (Eighth Highest Layer)]

Figure 7D:
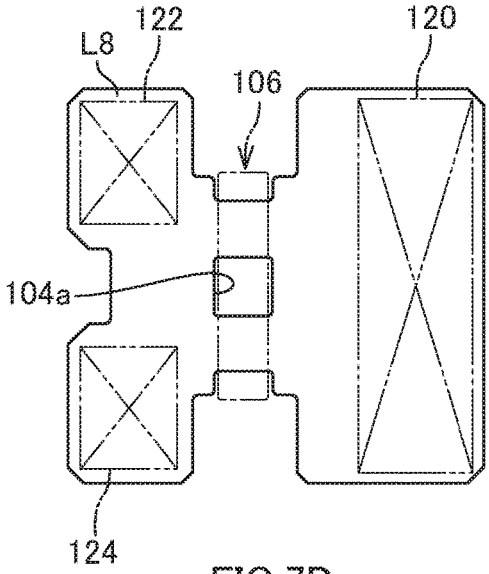

FIG. 7D: In the eighth layer L8, the primary circuit 120 and the two systems of secondary circuits 122, 124 (including the wiring patterns and mounted components) are formed as described above, but none of the primary winding 120*b* and the secondary windings 122*b*, 124*b* is formed. Further, insulation distances of the primary circuit 120 and the secondary circuits 122, 124 from the magnetic core 106 are large enough to improve withstand performance. In this embodiment, the eighth layer L8 has no primary winding 120*b* and secondary windings 122*b*, 124*b* either, and therefore they are not exposed to the periphery of the magnetic core 106, which also contributes greatly to an improvement in withstand performance.

As is apparent from the planar structures of the other layers, the insulation distance is further provided as follows in this embodiment.

(4) FIG. 7B: The sixth layer L6 is interposed as an insulating layer between the fifth layer L5 and the seventh layer L7, and in the sixth layer L6, in its regions overlapping with the primary winding 120*b* and the secondary winding 124*b* in the layer direction, neither of these wiring patterns is formed. Consequently, the insulation distance corresponding to two layers (larger than one layer) is provided between the primary winding 120*b* and the secondary winding 124*b*.

(5) FIG. 7A and FIG. 7C: The primary winding 120*b* and the secondary winding 124*b* are both arranged such that not only their outer peripheral ends but also their inner peripheral ends are apart in the outward direction from the middle legs 107*a* of the magnetic core 106. Specifically, the secondary winding 124*b* of the seventh layer L7 is arranged such that neither of its inner peripheral end and outer peripheral end overlaps with the primary winding 120*b* of the fifth layer L5 in the layer direction, and the primary winding 120*b* of the fifth layer L5 is arranged such that neither of its inner peripheral end and outer peripheral end overlaps with the secondary winding 122*b* of the seventh layer L7 in the layer direction. Accordingly, in the fifth layer L5, the positions of the secondary via holes 128 are outside the winding region of the primary winding 120*b*, and a predetermined insulation distance DI is provided therebetween. Further, in the seventh layer L7, the positions of the primary via holes 126 are outside the winding region of the secondary winding 124*b*, and a predetermined insulation distance DI is also provided therebetween. Note that the insulation distances DI in the fifth layer L5 and the seventh layer L7 may be different.

(6) FIG. 7D: In addition, the non-exposure of the secondary winding 124*b* to the outer surface (lower surface) of the circuit board module 104 also ensures that the insulation distance is provided from the magnetic core 106.

According to the electronic component 100 of this embodiment, by providing the insulation distance among the primary circuit 120, the secondary circuit 122, and the magnetic core 106, it is possible to improve the withstand performance of the whole circuit. Therefore, in the case where the electronic component 100 is the DC-DC converter, it is usable in a higher-voltage region, which can enhance its general versatility and applicability.

The embodiment has the circuit structure including the two systems of secondary circuits 122, 124, but it may have a circuit structure including only the single system of secondary circuit 122 (or secondary circuit 124) for the primary circuit 120. The layer structure in this case can be a six-layer structure of the layers in FIG. 6A, FIG. 6B, FIG. 6C, FIG. 6D, FIG. 7B, and FIG. 7C in the order from the top.

The patterns of the primary winding 120*b* and the secondary windings 122*b*, 124*b* are not limited to the examples illustrated in FIG. 6A to FIG. 6D and FIG. 7A to FIG. 7D, and may have other pattern shapes. For example, the pattern of the primary winding 120*b* may have such a pattern shape that its portions except the inner peripheral end and the outer peripheral end are closer to the middle legs 107*a* of the magnetic core 106. Further, the positions of the inner peripheral ends and the outer peripheral ends of the primary winding 120*b* and the secondary windings 122*b*, 124*b* may be more apart from the middle legs 107*a* than in the examples illustrated in FIG. 6B, FIG. 6D, FIG. 7A, and FIG. 7C.

The magnetic core 106 may be of another type such as an E-I type, a U-U type and a U-I type besides the E-E type. Further, the two core parts 106*a*, 106*b* may be bonded together with an adhesive, may be bonded together with an adhesive tape, or may be fixed with a member such as a clip sandwiching these.

The outer shape of the circuit board module 104 is not limited to the illustrated example, and may be a circular shape or any other polygonal shape.

In the embodiment, the electronic component 100 is the DC-DC converter, but may be implemented as a planar transformer or a reactor.

Besides, the structure described with reference to the drawings in the embodiment is only a preferred example. Various kinds of elements may be added to the basic structure of the embodiment, or some of the elements may be replaced.

What is claimed is:

1. An electronic component comprising:

a circuit board with a multilayer structure comprising a primary circuit and a secondary circuit each of which comprises a plurality of layers of wiring patterns;

a magnetic core attached to the circuit board to magnetically couple the primary circuit and the secondary circuit;

wherein the primary circuit comprises a primary winding constituted by one of the wiring patterns which is formed spirally around the magnetic core in a first layer inside the circuit board, wherein a winding region and both ends of the primary winding are fully located in the first layer, and the both ends of the primary winding are at positions not overlapping with a winding region of another winding located in a different layer when viewed in a layer direction;

wherein the secondary circuit comprises a secondary winding constituted by another one of the wiring patterns which is formed spirally around the magnetic core in a second layer inside the circuit board, wherein a winding region of the secondary winding overlaps with the winding region of the primary winding in the layer direction, the winding region and both ends of the secondary winding are fully located in the second layer, and the both ends of the secondary winding are at positions not overlapping with the winding region of the primary winding when viewed in the layer direction; and wherein the electronic component further comprises:

an insulating layer interposed between the first layer and the second layer inside the circuit board and not having the wiring patterns in regions that overlap with the windings in the layer direction; and a via hole formed inside the circuit board which passes through both the first layer and the insulating layer, and connects to both the secondary circuit and the secondary winding, wherein in the first layer, the via hole is arranged outside the region of the primary winding to have a predetermined insulation distance from the primary winding.

2. The electronic component according to claim 1, wherein the primary winding and the secondary winding are formed by wiring patterns only inside the circuit board and not on outer surfaces of the circuit board.

3. An electronic component comprising:

a circuit board with a multilayer structure comprising a primary circuit and a secondary circuit each of which comprises a plurality of layers of wiring patterns;

a magnetic core attached to the circuit board to magnetically couple the primary circuit and the secondary circuit;

wherein the primary circuit comprises a primary winding constituted by one of the wiring patterns which is formed spirally around the magnetic core in a first layer inside the circuit board;

wherein the secondary circuit comprises a secondary winding constituted by another one of the wiring patterns which is formed spirally around the magnetic core in a second layer inside the circuit board; and wherein the electronic component further comprises:

a first set of via holes which are formed inside the circuit board and located outside a region that overlaps with the secondary winding in a layer direction, and which connect both ends of the primary winding which are located in the first layer to the wiring patterns of other layers; and a second set of via holes which are formed inside the circuit board and located outside a region that overlaps with the primary winding in the layer direction, and which connect both ends of the secondary winding which are located in the second layer to the wiring patterns of other layers.

4. The electronic component according to claim 3, wherein a winding region of the primary winding and a winding region of the secondary winding overlap with each other in the layer direction inside the circuit board, and wherein both ends of the primary winding located in the first layer are at positions not overlapping with the winding region of the secondary winding in the layer direction, and both ends of the secondary winding located in the second layer are at positions not overlapping with the winding region of the primary winding in the layer direction.

5. The electronic component according to claim 3, wherein the primary winding and the secondary winding are formed by wiring patterns only inside the circuit board and not on outer surfaces of the circuit board.

6. The electronic component according to claim 5, wherein a winding region of the primary winding and a winding region of the secondary winding overlap with each other in the layer direction inside the circuit board, and wherein both ends of the primary winding located in the first layer are at positions not overlapping with the winding region of the secondary winding in the layer direction, and both ends of the secondary winding located in the second layer are at positions not overlapping with the winding region of the primary winding in the layer direction.

7. An electronic component comprising:

a circuit board with a multilayer structure comprising a primary circuit and a secondary circuit each of which comprises a plurality of layers of wiring patterns;

a magnetic core attached to the circuit board to magnetically couple the primary circuit and the secondary circuit;

wherein the primary circuit comprises a primary winding constituted by one of the wiring patterns which is formed spirally around the magnetic core in a first layer inside the circuit board;

wherein the secondary circuit comprises a secondary winding constituted by another one of the wiring patterns which is formed spirally around the magnetic core in a second layer inside the circuit board; and wherein the electronic component further comprises:

an insulating layer interposed between the first layer and the second layer inside the circuit board and not having the wiring patterns in regions that overlap with the windings in a layer direction;

a first set of via holes which are formed inside the circuit board and located outside a region that overlaps with the secondary winding in the layer direction, and which connect both ends of the primary winding located in the first layer to the wiring patterns of other layers; and a second set of via holes which are formed inside the circuit board and located outside a region that overlaps with the primary winding in the layer direction, and which connect both ends of the secondary winding located in the second layer to the wiring patterns of other layers.

8. The electronic component according to claim 7, wherein a winding region of the primary winding and a winding region of the secondary winding overlap with each other in the layer direction inside the circuit board, and wherein both ends of the primary winding located in the first layer are at positions not overlapping with the winding region of the secondary winding in the layer direction, and both ends of the secondary winding located in the second layer are at positions not overlapping with the winding region of the primary winding in the layer direction.

9. The electronic component according to claim 7, wherein the primary winding and the secondary winding are formed by wiring patterns only inside the circuit board and not on outer surfaces of the circuit board.

10. The electronic component according to claim 9, wherein a winding region of the primary winding and a winding region of the secondary winding overlap with each other in the layer direction inside the circuit board, and wherein both ends of the primary winding located in the first layer are at positions not overlapping with the winding region of the secondary winding in the layer direction, and both ends of the secondary winding located in the second layer are at positions not overlapping with the winding region of the primary winding in the layer direction.

* * * * *